US007437802B2

(12) United States Patent
Ochiai

(10) Patent No.: US 7,437,802 B2
(45) Date of Patent: Oct. 21, 2008

(54) DOOR HINGE WITH CHECKER

(75) Inventor: Manabu Ochiai, Saitama (JP)

(73) Assignee: Rikenkaki Kogyo Kabushiki Kaisha, Saitama (JP)

( * ) Notice: Subject to any disclaimer, the term of this patent is extended or adjusted under 35 U.S.C. 154(b) by 127 days.

(21) Appl. No.: 11/212,094

(22) Filed: Aug. 26, 2005

(65) Prior Publication Data

US 2006/0053588 A1 Mar. 16, 2006

(30) Foreign Application Priority Data

Aug. 27, 2004 (JP) ..... 2004-248165

(51) Int. Cl.
*E05D 11/10* (2006.01)

(52) U.S. Cl. ..... 16/334; 16/86 C

(58) Field of Classification Search ..... 16/86 C, 16/82, 85, 335, 334, 308, 332, 327; 296/146.11, 296/146.12
See application file for complete search history.

(56) References Cited

U.S. PATENT DOCUMENTS 3,408,684 A * 11/1968 Marchione ..... 16/334
3,434,179 A * 3/1969 Marchione ..... 16/334
3,729,772 A * 5/1973 Marchione ..... 16/334
3,820,192 A * 6/1974 Nakano et al. ..... 16/334
4,285,098 A * 8/1981 Hicks et al. ..... 16/308
5,850,673 A * 12/1998 Wood et al. ..... 16/334

FOREIGN PATENT DOCUMENTS

DE 3223938 A1 * 12/1983
DE 4447273 A1 * 7/1996
JP 2001-295535 A 10/2001

* cited by examiner

*Primary Examiner*—Chuck Y. Mah
(74) *Attorney, Agent, or Firm*—Arent Fox LLP

(57) ABSTRACT

A door hinge with a checker include: a first hinge arm and a second hinge arm which are connected to be relatively rotatable by a hinge pin; a check cam which is provided at the first hinge arm and has positioning recessed portions on its outer peripheral surface; a roller which moves on the outer peripheral surface of the check cam and engages with the positing recessed portions in accordance with relative rotation of the first and second hinge arms; and a torsion spring which resiliently urges the roller toward the outer peripheral surface of the check cam. A torsion shaft portion is connected via a reinforcing member to a free end part of a movable arm portion in the torsion spring. Thus, shaking of the door when the roller resiliently engages with the positioning recessed portion of the check cam by torsional load of the torsion spring is prevented.

4 Claims, 7 Drawing Sheets

DOOR HINGE WITH CHECKER

RELATED APPLICATION DATA

The present invention is based upon Japanese priority application No. 2004-248165, which is hereby incorporated in its entirety herein by reference.

BACKGROUND OF THE INVENTION

1. Field of the Invention

The present invention relates to a door hinge with a checker which is used for an automobile and the like, and particularly to an improvement of a door hinge with a checker, comprising: a first hinge arm fixed to one of a body and a door; a second hinge arm fixed to the other one of the body and the door; a hinge pin which relatively rotatably connects together the first and second hinge arms; a check cam which is provided at the first hinge arm and has positing recessed portions on an outer peripheral surface; an engaging member which moves on the outer peripheral surface of the check cam and engages with the positioning recessed portions in accordance with relative rotation of the first and the second hinge arms; and a torsion spring which resiliently urges the engaging member toward the outer peripheral surface of the check cam, the torsion spring including: a torsion shaft portion supported by the first hinge arm 1; a U-shaped fixed arm portion which extends from one end of the torsion shaft portion and which has a fixed end part fixed to the first hinge arm; and a movable arm portion which extends from the other end of the torsion shaft portion and which has a free end part that supports the engaging member and elastically urges the engaging member to the outer peripheral surface side of the check cam by torsional load of the torsion shaft portion.

2. Description of the Related Art

Japanese Patent Application Laid-open No. 2001-295535 discloses a conventional door hinge with a checker.

In the conventional door hinge with a checker, when the door is opened to a predetermined opening degree at which an engaging member engages with a positioning recessed portion of a check cam, the door sometimes shakes for a short time until it is settled at the predetermined opening degree, and the shaking somewhat gives an uncomfortable sensation to a passenger.

The present inventor cleared up the cause of such shaking of a door as follows. Namely, in the state in which the engaging member of the free end part of the movable arm portion is resiliently engaged with the check cam by a torsional load applied to a torsion shaft portion, as light deformation occurs in the movable arm portion. Therefore, when the engaging member engages strongly and swiftly with the positioning recessed portion of the check cam, the deformation state of the movable arm portion abruptly changes, whereby deformation vibration occurs in the movable arm portion to shake the door.

SUMMARY OF THE INVENTION

The present invention has been achieved based on such an investigation of the cause, and has an object to provide a door hinge with a checker which prevents a door from shaking when the door is opened at a predetermined opening degree at which the engaging member engages with the positioning recessed portion of a check cam by reinforcing rigidity of a movable arm portion of a torsion spring so as to suppress the deformation vibration.

In order to achieve the above-mentioned object, according to a first feature of the invention, there is provided a door hinge with a checker, comprising: a first hinge arm fixed to one of a body and a door; a second hinge arm fixed to the other one of the body and the door; a hinge pin which relatively rotatably connects together the first and second hinge arms; a check cam which is provided at the first hinge arm and has positing recessed portions on an outer peripheral surface; an engaging member which moves on the outer peripheral surface of the check cam and engages with the positioning recessed portions in accordance with relative rotation of the first and the second hinge arms; and a torsion spring which resiliently urges the engaging member toward the outer peripheral surface of the check cam, the torsion spring including: a torsion shaft portion supported by the first hinge arm; a U-shaped fixed arm portion which extends from one end of the torsion shaft portion and which has a fixed end part fixed to the first hinge arm; and a movable arm portion which extends from the other end of the torsion shaft portion and which has a free end part that supports the engaging member and elastically urges the engaging member to the outer peripheral surface side of the check cam by torsional load of the torsion shaft portion, wherein the torsion shaft portion is connected via a reinforcing member to the free end part of the movable arm portion.

The engaging member corresponds to the roller 22 in the embodiment of the present invention which will be described later.

With the first feature of the present invention, the torsion shaft portion and the free end part of the movable arm are connected by the reinforcing member, thereby enhancing the rigidity of the movable arm portion. As a result, when torsional load is applied to the torsion shaft, the movable arm portion is not deformed. Accordingly, even when the engaging member is resiliently engaged strongly and swiftly with each of the positioning recessed portions by the torsional load of the torsion shaft portion, shaking of the door by the deformation vibration of the movable arm portion is prevented, so that a favorable feeling of opening and closing the door can be given to the passengers.

According to a second feature of the present invention, in addition to the first feature, the reinforcing member is linearly disposed inside a bent portion of the movable arm portion.

With the second feature of the present invention, the rigidity of the movable arm portion can be effectively enhanced with the remarkably simple structure, and further the dead space inside the U-shaped bent portion of the movable arm portion is utilized for installation of the reinforcing member, thus avoiding increase in size of the door hinge with a checker.

According to a third feature of the present invention, in addition to the first or second feature, the reinforcing member is provided with a bush in which the torsion shaft portion and the free end part of the movable arm portion are respectively fitted.

With the third feature of the present invention, a gap between the reinforcing member and the torsion spring is reliably eliminated by the bush to further enhance the effect of reinforcing the movable arm portion by the reinforcing member, and occurrence of the vibration noise of the reinforcing member can be suppressed.

The above-mentioned object, other objects, characteristics, and advantages of the present invention will become apparent from an explanation of a preferred embodiment, which will be described in detail below by reference to the attached drawings.

DESCRIPTION OF THE PREFERRED EMBODIMENT

Figure 1:
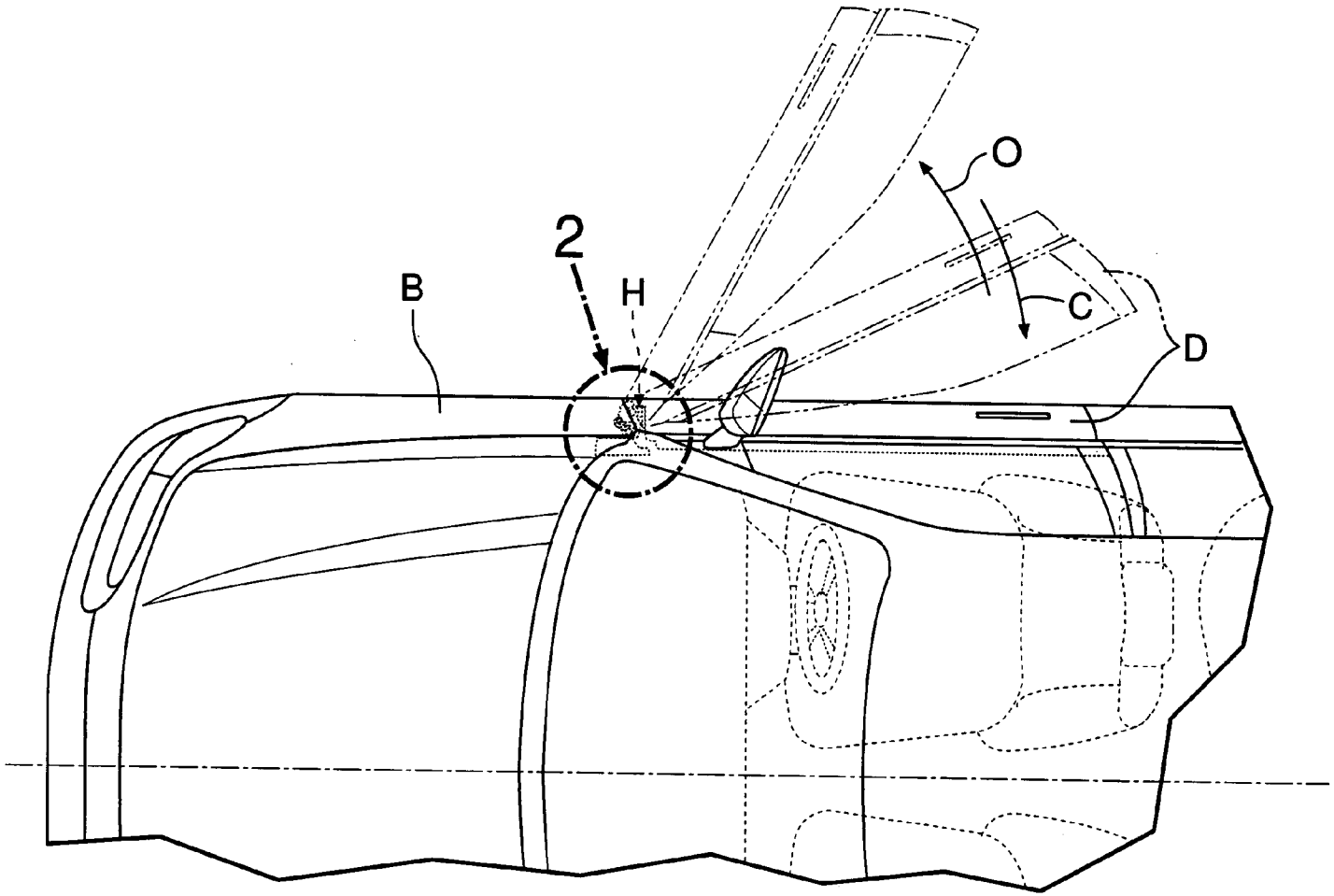
FIG. 1 is a plane view of an automobile including a door hinge with a checker of the present invention.

First, in FIG. 1, a door D which opens and closes an entrance is mounted to a body B of an automobile via a door hinge H with a checker according to the present invention.

In FIGS. 2 to 6, the door hinge H with a checker includes: a first hinge arm 1 fixed to the door D; a second hinge arm 2 fixed to the body B; a hinge pin 3 with an enlarged head portion 3*a* which connects the hinge arms 1 and 2 to be relatively rotatable, and a checker 4 which is provided between the hinge arms 1 and 2 and gives stepwise moderation resistance to relative rotation of the hinge arms 1 and 2.

Figure 5:
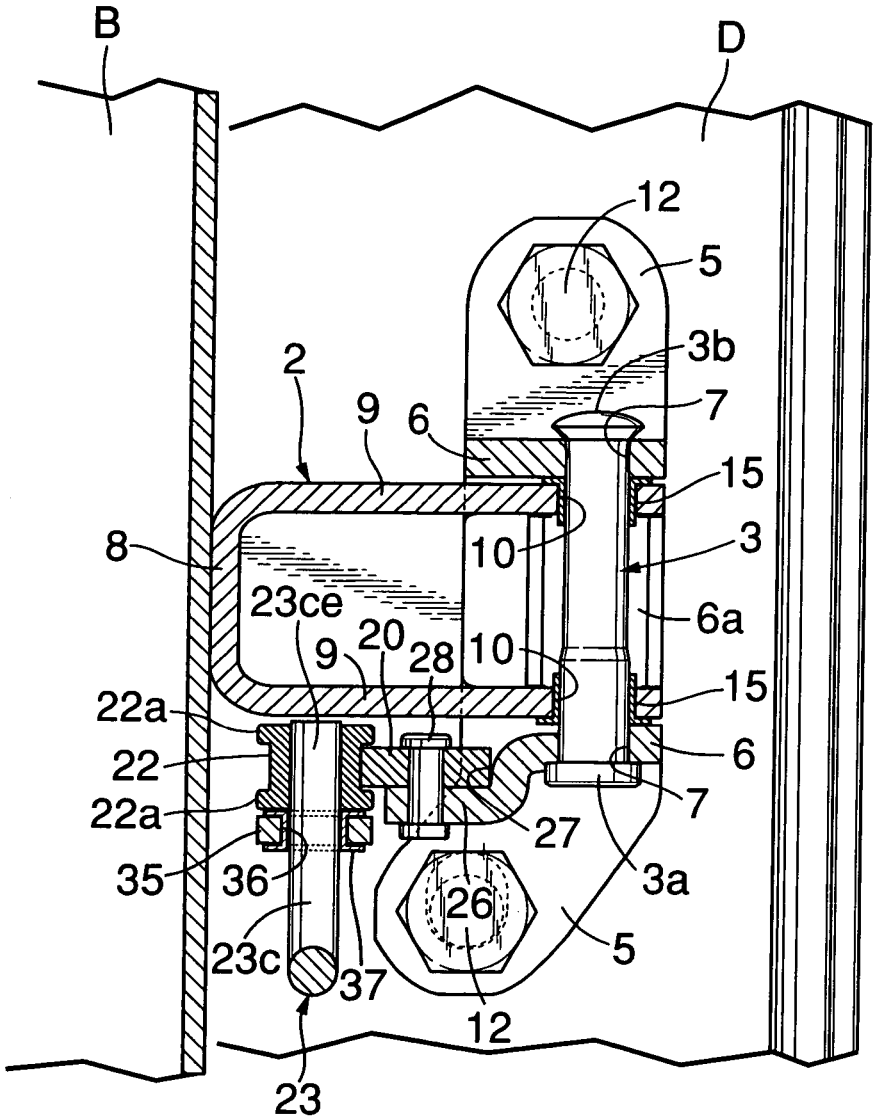
FIG. 5 is a sectional view taken along a line 5 to 5 in FIG. 2.
Figure 6:
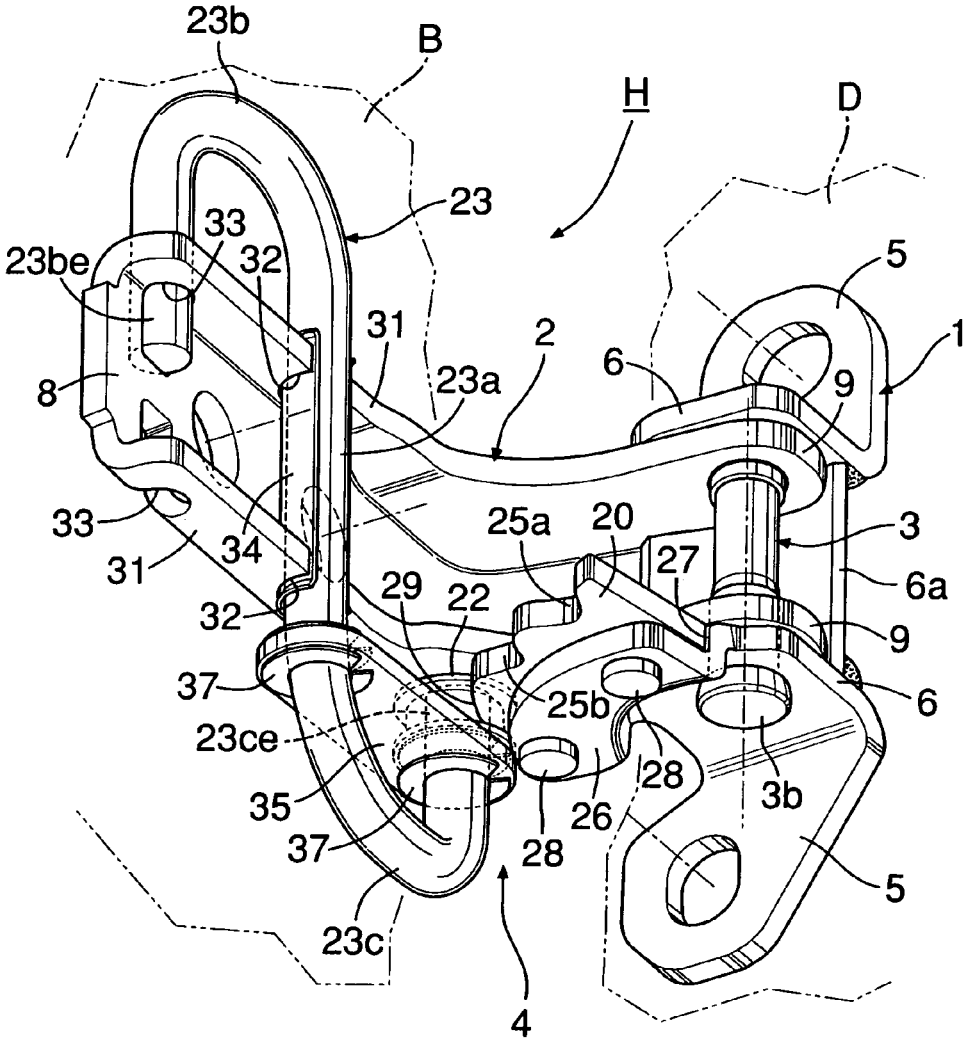
FIG. 6 is a perspective view of the door hinge with a checker.
Figure 7:
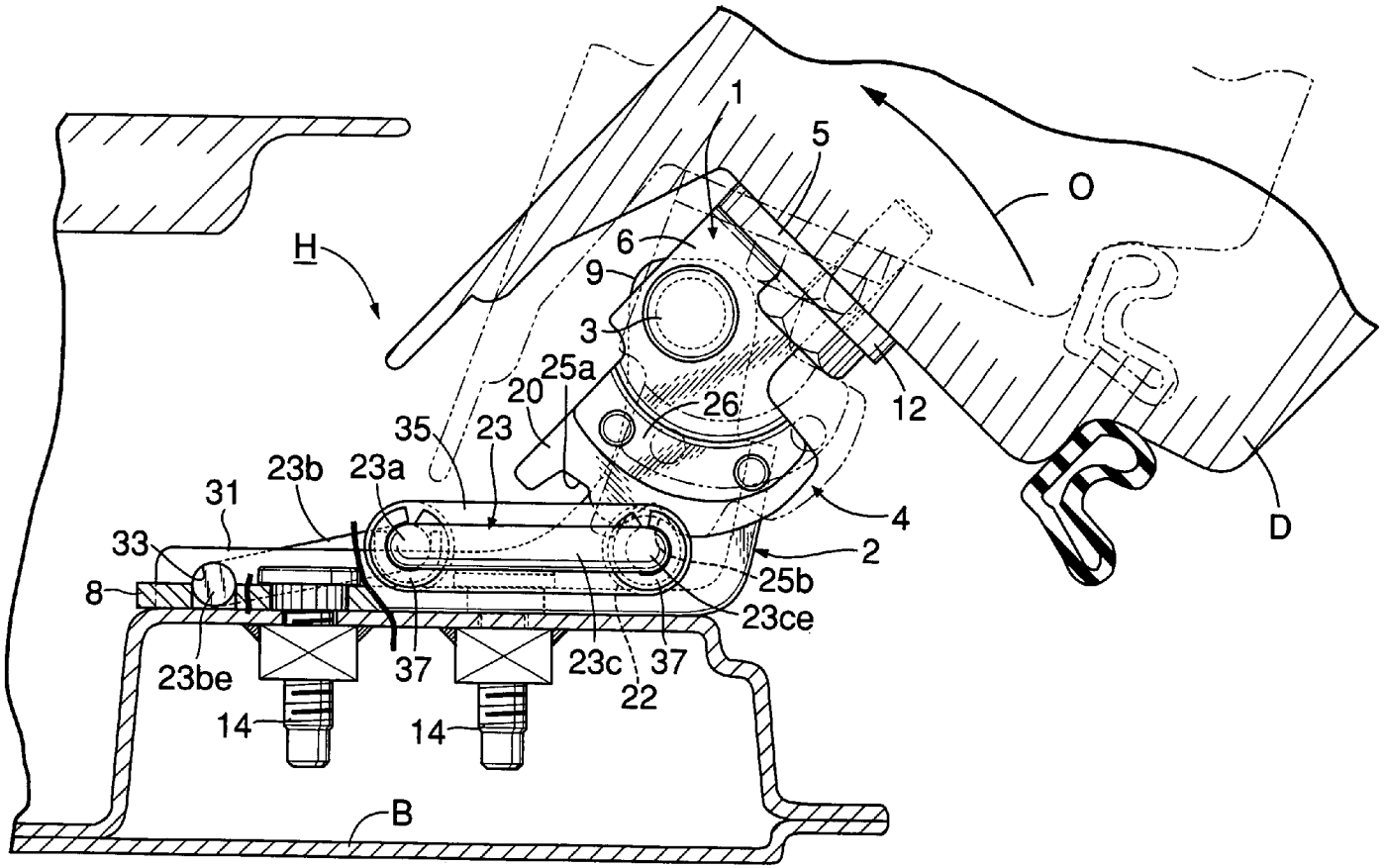
FIG. 7 is a view for explaining an operation in a state in which the door is opened to an intermediate opening degree.

As shown in FIGS. 5 and 6, the first hinge arm 1 includes: a pair of fixed base portions 5 and 5; a pair of outer arm portions 6 and 6 rising from opposed edges of the fixed base portions 5 and 5 to be opposed to each other; and a connecting portion 6*a* which integrally connects base ends of the outer arm portions 6 and 6. The fixed base portions 5 and 5 are fixed by bolts 12 to an end wall of the door D. A pair of pin holes 7 and 7 which are coaxially aligned with each other are provided in tip ends of the outer arm portions 6 and 6.

Figure 2:
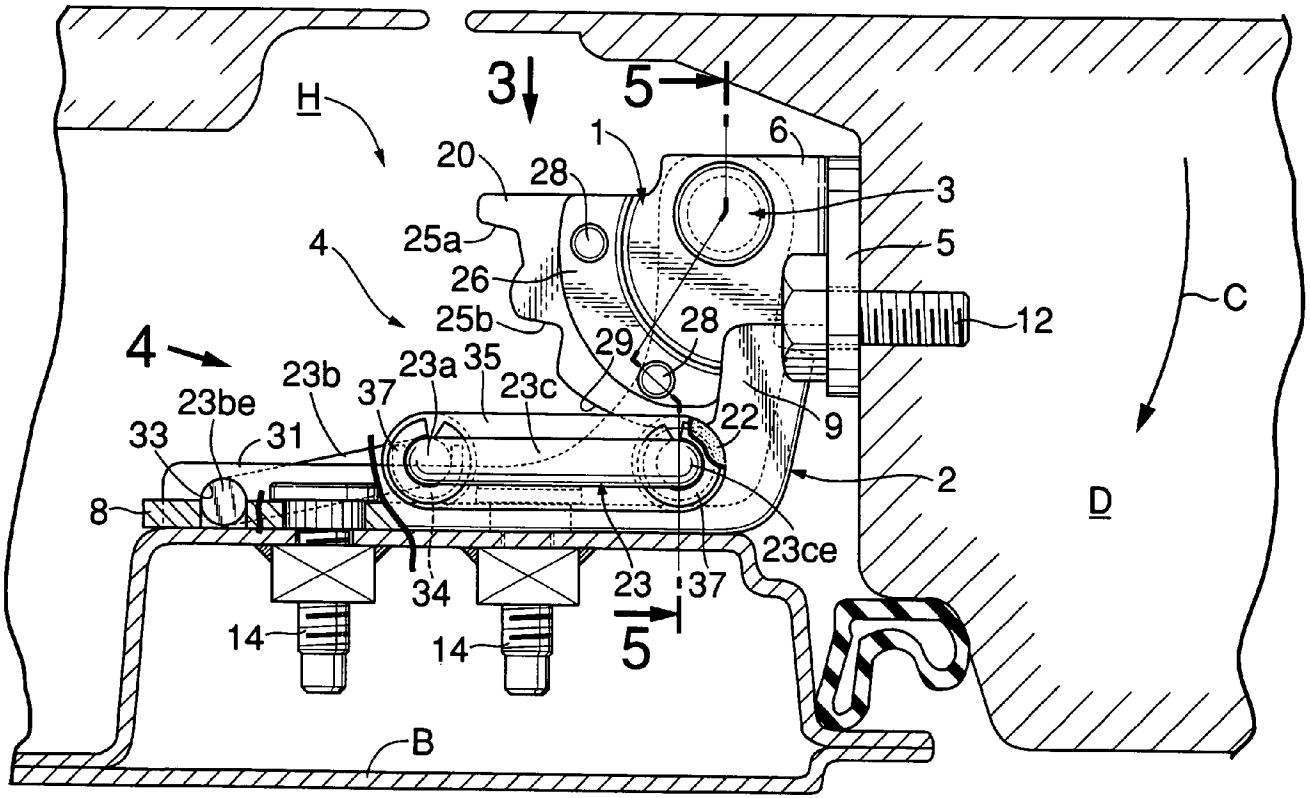
FIG. 2 is an enlarged plane view of a portion 2 in FIG. 1, shown in a fully closed state of a door.
Figure 3:
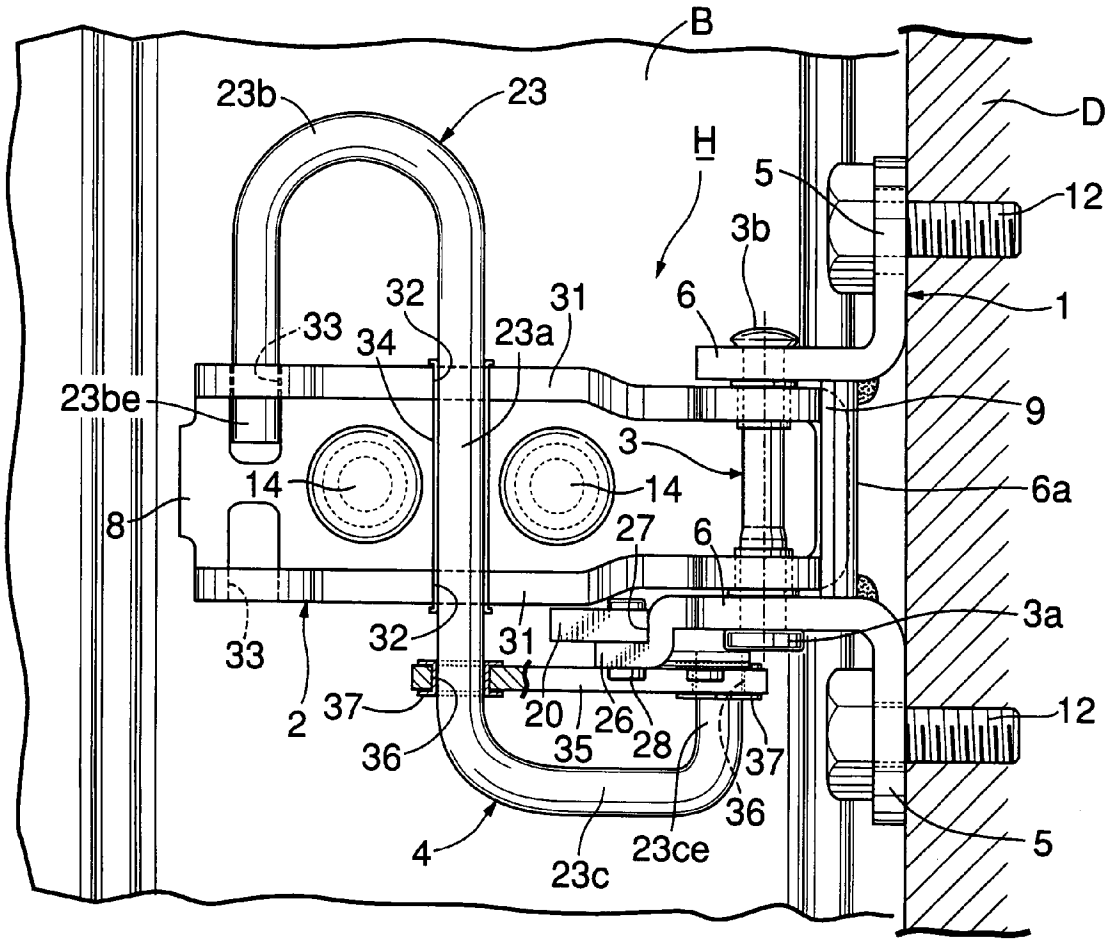
FIG. 3 is a view taken from an arrow 3 in FIG. 2.
Figure 4:
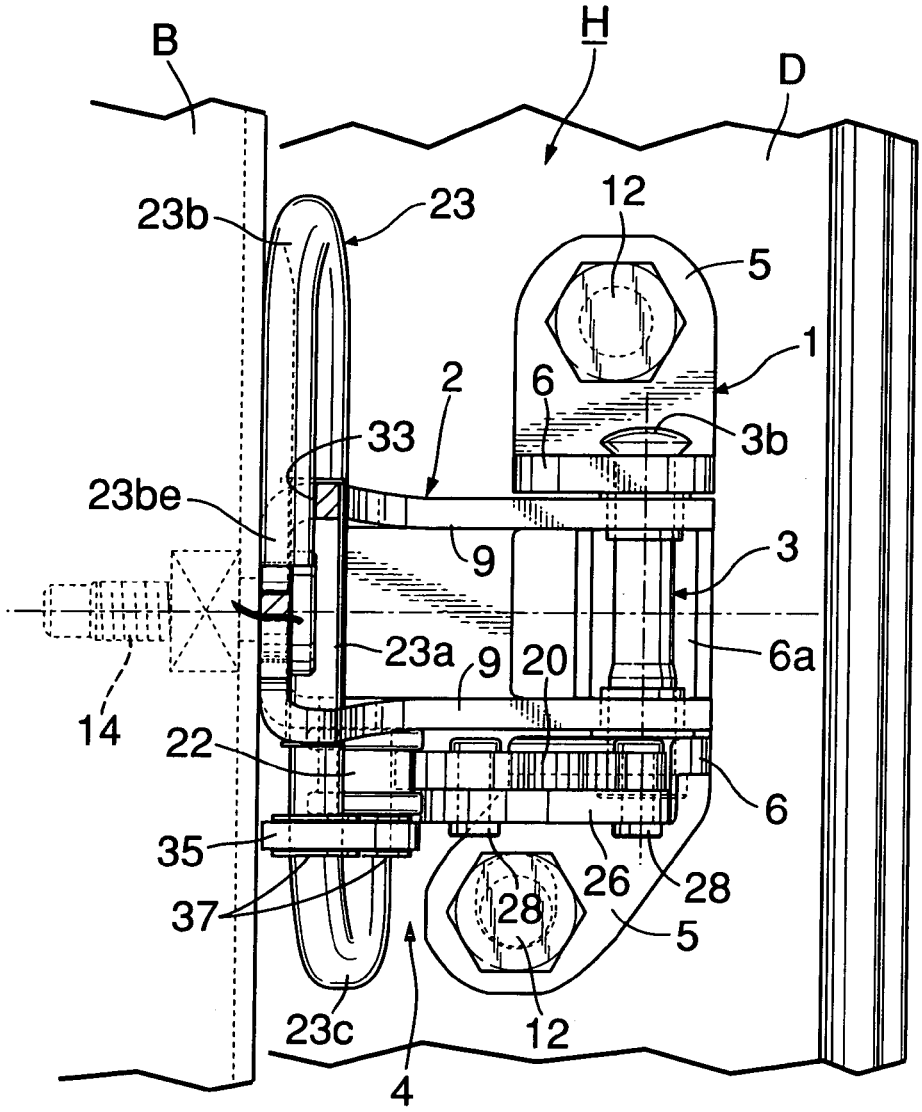
FIG. 4 is a view taken from an arrow 4 in FIG. 2.

As shown in FIGS. 2, 5 and 6, the second hinge arm 2 includes: a rectangular fixed base portion 8; and a pair of inner arm portions 9 and 9 which rise from one end portion of the fixed base portion 8 and are opposed to each other. The fixed base portion 8 is fixed by bolts 14 to the body B. The inner arm portions 9 and 9 have pin holes 10 and 10 in which bushes 15 and 15 are fitted. The inner arm portions 9 are inserted into the outer arm portions 6 so that the bushes 15 and 15 are aligned with the pair of pin holes 7 and 7. Then, the hinge pin 3 with the enlarged head portion 3*a* is fitted into the pin holes 7 and 7 and the bushes 15 and 15, thereby relatively rotatably connecting together the first and second hinge arms 1 and 2. An enlarged portion 3*b* for prevention of slipping-off is formed at the tip end of the hinge pin 3 by crimping.

In the drawing, a reference character O denotes an opening direction of the door D and a reference character C denotes a closing direction.

In FIGS. 2 to 6, the checker 4 includes: a checker cam 20 which is reveted on the first hinge arm 1; a torsion spring 23 mounted to the second hinge arm 2; and a roller 22 which is supported at a free end part of the torsion spring 23 to resiliently engage with the checker cam 20.

The checker cam 20 is manufactured separately from the first hinge arm 1 as shown in FIGS. 5 and 6, forms an arc plate shape as a whole, and has a plurality of positioning recessed portions 25*a* and 25*b* arranged in a circumferential direction on its outer peripheral surface. A mounting flange 26, which is spaced from the inner arm portion 9 adjacent to the outer arm portion 6, is integrally connected to the one of the outer arm portions 6 of the first hinge arm 1, to which the check cam 20 is mounted, via an arc-shaped positioning step portion 27. The check cam 20 is superposed on the mounting flange 26 while its inner peripheral surface is engaged with the positioning step portion 27, and is fixed to the mounting flange 26 with a plurality of rivets 28 and 28.

An outer peripheral surface of the check cam 20 projects in a radially outward direction from an outer peripheral surface of the mounting flange 26. The plurality of positioning recessed portions 25*a* and 25*b* are arranged in the circumferential direction, on the outer peripheral surface of the check cam 20. In the example shown in the drawings, the positioning recessed portions 25*a* and 25*b* are disposed at two spots, that is, an end portion at an outer side from the door D and an intermediate portion of the outer peripheral surface of the check cam 20; and a portion between the intermediate positioning recessed portion 25*b* and an end portion at an inner side to the door D is formed to be an inclined plane 29 which is closer to a hinge pin 3 side toward the end portion.

Because the checker cam 20 is manufactured separately from the first hinge arm 1 as described above, the door hinges H with plural types of checkers differing in the check characteristic can be obtained, by preparing plural types of checker cams 20 differing in the outer peripheral shape such as the position, the number and the like of the positioning recessed portions 25*a* and 25*b*, and fixing them to the first hinge arms 1 having the corresponding structures. Also, as the check cam 20 and the first hinge arm 1 are separately manufactured, the materials corresponding to the respective functions can be used. For example, the check cam 20 is formed of sintered metal, and is impregnated with oil, whereby the check cam 20 can be easily formed with a favorable precision even when the check cam 20 has a comparatively complicated shape, and at the same time, noise prevention at the time of rolling of the roller 22 can be achieved.

As is clearly shown in FIGS. 2 and 6, in the second hinge arm 2, a pair of ribs 31 and 31 which project to a surface side of the fixed base portion 8 and connect to both the inner arm portions 9 and 9 are integrally formed at both upper and lower side edges of the rectangular fixed base portion 8. A semicylindrical bush 34 is fitted in a pair of semicircular first notches 32 and 32 provided in intermediate portions of the ribs 31 and 31 while extending over them. A pair of semicircular second notches 33 and 33, which are arranged in parallel with the first notches 32 and 32, are provided on a back surface (surface at the side of the body B) at the end portion on the side opposite from the inner arm portions 9 and 9. Openings of the second notches 33 and 33 are closed by a mounting surface of the body B to which the fixed base portion 8 is fixed.

On the other hand, the torsion spring 23 formed of one spring wire rod, and is constituted of a torsion shaft portion 23*a*, a U-shaped fixed arm portion 23*b* which extends from one end of the torsion shaft portion 23*a*, and a similarly U-shaped movable arm portion 23*c* which extends from the other end of the torsion shaft portion 23*a*. The torsion spring 23 is disposed so that the torsion shaft portion 23*a* is supported by the first notches 32 and 32 via the bush 34, a fixed end part 23*be* of the fixed arm portion 23*b* is supported by one of the second notches 33 and 33, and a free end part 23*ce* of the movable arm portion 23*c* rotatably supports the roller 22, and a set load in a torsional direction is applied to the torsion shaft portion 23*a* so as to resiliently urge the free end part 23*ce* to the outer peripheral surface side of the check cam 20. Namely, in the free state of the torsion spring 23, when the fixed end part 23*be* and the torsion shaft portion 23*a* are supported by one of the second notches 33 and the bush 34, the movable arm portion 23*c* rises from the fixed base portion 8; and when the movable arm portion 23*c* is turned to the fixed base portion 8 side in order to bring the roller 22 of the free end part 23*ce* into contact with the outer peripheral surface of the check cam 20, a repulsive force in the torsional direction occurs in the torsion shaft portion 23*a* due to such a turning, and presses the free end part 23*ce* to the outer peripheral surface side of the check cam 20.

A pair of flange portions 22*a* and 22*a* are formed at opposite ends of the roller 22, and disposed to sandwich the check cam 20 from opposite sides, whereby the roller 22 is prevented from separating from the free end part 23*ce*.

The torsion shaft portion 23*a* and the free end part 23*ce* of the movable arm portion 23*c* are connected together by a reinforcing member 35. The reinforcing member 35 is formed of a metal plate having a high rigidity, and is provided with a pair of mounting holes 36 and 36 at opposite ends. A bush 37 whose inner surface is coated with a synthetic resin is fitted in each of the mounting holes 36. When mounting the reinforcing member 35 to the torsion spring 23, before the torsion spring 23 is mounted to the second hinge arm 2, the bush 37 fitted in one of the mounting hole 36 of the reinforcing member 35 is fitted onto the free end part 23*ce* and is moved to an intermediate portion of the torsion shaft portion 23*a* once; and then, the reinforcing member 35 is moved along the torsion shaft portion 23*a* so that the bush 37 fitted in the other mounting hole 36 is fitted onto the free end part 23*ce*. Thereafter, the roller 22 is fitted on the free end part 23*ce*. In this manner, the reinforcing member 35 is linearly disposed inside a U-shaped bent portion of the movable arm portion 23*c*.

Next, an operation of the embodiment will be described.

When the door D is opened and closed, the first and the second hinge arms 1 and 2 relatively rotate with the hinge pin 3 as a fulcrum, the roller 22 correspondingly rolls while pressing the outer peripheral surface of the check cam 20 with the set load of the torsion spring 23, so that the roller 22 generates a modulation resistance against turning of the door D each time the roller 22 resiliently engages with the positioning recessed portions 25*a* and 25*b*. Accordingly, when the roller 22 engages with the respective positioning recessed portions 25*a* and 25*b*, if the opening and closing force to the door D is released, the door D can be kept in the position by the resistance.

In the torsion spring 23, the torsion shaft portion 23*a* and the free end part 23*ce* of the movable arm portion 23*c* are connected together by the reinforcing member 35, whereby the U-shaped movable arm portion 23*c* is reinforced in rigidity, so that when the torsional load is applied to the torsion shaft portion 23*a*, the movable arm portion 23*c* is not deformed. Therefore, even when the roller 22 is resiliently engaged with each of the positioning recessed portions 25*a* and 25*b* strongly and swiftly with the torsional load of the torsion shaft portion 23*a*, deformation vibration of the movable arm portion 23*c* is effectively prevented to immediately stabilize the door D at a predetermined opening degree, thereby giving a favorable feeling of opening and closing the door to a passenger.

Particularly, since the reinforcing member 35 is disposed linearly inside the U-shaped bent portion of the movable arm portion 23*c* as described above, the rigidity of the movable arm portion 23*c* can be effectively enhanced with the remarkably simple structure, and further the dead space inside the U-shaped bent portion of the movable arm portion 23*c* is utilized for installation of the reinforcing member 35, which does not bring about increase in size of the door hinge H with a checker.

The reinforcing member 35 is provided with the bushes 37 in which the torsion shaft portion 23*a* and the free end part 23*ce* of the movable arm portion 23*c* are respectively fitted, and at least the inner surface of each bush 37 is coated with the synthetic resin. Therefore, a gap between the reinforcing member 35 and the torsion spring 23 can be reliably eliminated, thereby further enhancing the effect of reinforcing the movable arm portion 23*c* by the reinforcing member 35, so that occurrence of vibration noise of the reinforcing member 35 can be suppressed.

The present invention is not limited to the above described embodiment, and various design changes can be made without departing from the subject matter of the invention. For example, the present invention is applicable not only to the door for the entrance of an automobile, but also to a door hinge with a checker of the door for opening and closing a luggage compartment. The first hinge arm 1 can be fixed to the door D, and the second hinge arm 2 can be fixed to the body B. The check cam 20 may be fixed to the mounting flange 26 by welding. The positioning recessed portions 25*a* and 25*b* of the check cam 20 can be formed between a plurality of arranged rollers, and the number and place of the positioning recessed portions 25*a* and 25*b* can be freely selected.

What is claimed is:

1. A door hinge with a checker, comprising:

a first hinge arm fixed to one of a body and a door;

a second hinge arm fixed to the other one of the body and the door;

a hinge pin which relatively rotatably connects together the first and second hinge arms;

a check cam which is provided at the first hinge arm and has positioning recessed portions on an outer peripheral surface;

an engaging member which rotatably moves on the outer peripheral surface of the check cam and engages with the positioning recessed portions in accordance with relative rotation of the first and the second hinge arms; and a torsion spring which resiliently urges the engaging member toward the outer peripheral surface of the check cam, the torsion spring including: a torsion shaft portion supported by the second hinge arm; a U-shaped fixed arm portion which extends from one end of the torsion shaft portion and which has a fixed end part fixed to the second hinge arm; and a movable arm portion which extends from the other end of the torsion shaft portion and which has a free end part on which the engaging member is rotatably fitted and which elastically urges the engaging member to the outer peripheral surface side of the check cam by torsional load of the torsion shaft portion, wherein the torsion shaft portion is connected via a reinforcing member to the free end part of the movable arm portion.

2. The door hinge with a checker according to claim 1, wherein the reinforcing member is linearly disposed inside a bent portion of the movable arm portion.

3. The door hinge with a checker according to claim 1 or 2, wherein the reinforcing member is provided with a bush in which the torsion shaft portion and the free end part of the movable arm portion are respectively fitted.

4. The door hinge with a checker according to claim 1 or 2, wherein the reinforcing member is mounted on the torsion spring in a manner distanced from the second hinge arm.

* * * * *